US008491289B2

(12) United States Patent
Showalter

(10) Patent No.: US 8,491,289 B2
(45) Date of Patent: Jul. 23, 2013

(54) FRICTION DRIVE PUMP FOR TRANSFER CASES, ETC

(75) Inventor: Dan J. Showalter, Plymouth, MI (US)

(73) Assignee: Borgwarner Inc., Auburn Hills, MI (US)

( * ) Notice: Subject to any disclaimer, the term of this patent is extended or adjusted under 35 U.S.C. 154(b) by 478 days.

(21) Appl. No.: 12/741,615

(22) PCT Filed: Sep. 30, 2008

(86) PCT No.: PCT/US2008/011282

§ 371 (c)(1), (2), (4) Date: Jul. 19, 2010

(87) PCT Pub. No.: WO2009/064337

PCT Pub. Date: May 22, 2009

(65) Prior Publication Data

US 2010/0316519 A1 Dec. 16, 2010

Related U.S. Application Data

(60) Provisional application No. 61/003,030, filed on Nov. 14, 2007.

(51) Int. Cl.
*F01C 1/10* (2006.01)
*F04C 2/10* (2006.01)

(52) U.S. Cl.
USPC ..... 418/61.3; 418/32; 418/133; 418/135; 418/171

(58) Field of Classification Search
USPC ..... 418/32, 133, 135, 171, 188, 61.3
See application file for complete search history.

(56) References Cited

U.S. PATENT DOCUMENTS

| | | | |
|---|---|---|---|
| 3,299,824 | A | 1/1967 | Gauthier |
| 4,540,347 | A | 9/1985 | Child |
| 6,702,703 | B2 | 3/2004 | Gervais, III et al. |
| 2005/0202920 | A1 | 9/2005 | Kelley, Jr. |

FOREIGN PATENT DOCUMENTS

| | | | |
|---|---|---|---|
| JP | 64-004886 | U | 1/1989 |
| JP | 04-100087 | U | 8/1992 |
| JP | 08-121355 | A | 5/1996 |
| KR | 10-1998-0055180 | A | 9/1998 |

*Primary Examiner* — Zelalem Eshete

(57) ABSTRACT

A pump having an actuator mounted on a rotatable shaft, and a pump mounted on the shaft, which is selectively engageable with the actuator. When the actuator is actuated, the pump will receive rotational force from the shaft, creating a pumping. action.

10 Claims, 7 Drawing Sheets

FRICTION DRIVE PUMP FOR TRANSFER CASES, ETC

CROSS-REFERENCE TO RELATED APPLICATIONS

This application is a PCT International Application of U.S. Provisional Patent Application No. 61/003,030 filed on Nov. 14, 2007. The disclosure of the above application is incorporated herein by reference.

FIELD OF THE INVENTION

The present invention relates to selectively engagable fluid pumps which are used in a transfer case or transmission.

BACKGROUND OF THE INVENTION

Pumps are generally known and used for a variety of applications in transmissions and transfer cases. One of the most common ways pumps are used in these types of applications is for the generation of fluid pressure which can be used to actuate clutch assemblies or the like. One particular type of pump commonly used in transmissions and transfer cases is what is known as a "gerotor pump."

A gerotor pump usually consists of an inner gerotor which is mounted on a shaft, and an outer gerotor which circumscribes the inner gerotor. The inner gerotor usually has a series of lobes which are engagable with a corresponding series of lobes on the outer gerotor such that the inner gerotor transfers rotational force to the outer gerotor as the shaft and inner gerotor rotate. However, the outer gerotor usually has a larger number of lobes such that the diameter of the inner gerotor and the outer gerotor are different. The space between the inner gerotor and outer gerotor created by the different number of lobes causes a pumping action to be created when the inner gerotor and outer gerotor rotate.

A common drawback well known with gerotor pumps is an inability to deactivate the gerotor pump. The inner gerotor is typically mounted on the shaft through the use of a spline connection, and because the shaft is rotating, the inner gerotor is constantly driving the outer gerotor as the shaft rotates, regardless of whether a pumping action is needed or not. This often leads to situations where pumping action by the gerotor pump is unnecessary. Having these types of pumps active when the pumping action is not necessary can reduce the efficiency of the transmission or the transfer case.

Accordingly, there exists a need for a pump powered by a rotating shaft in a transmission or a transfer case which is selectively engagable.

SUMMARY OF THE INVENTION

The present invention is a pump which may be used in a transmission or transfer case. The pump includes an actuator mounted on a rotatable shaft which may or may not be a continuously rotating shaft. There is also a pumping device mounted on the shaft, which is selectively engageable with the actuator. When the actuator is actuated, the pumping device will receive rotational force from the shaft, creating a pumping action.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
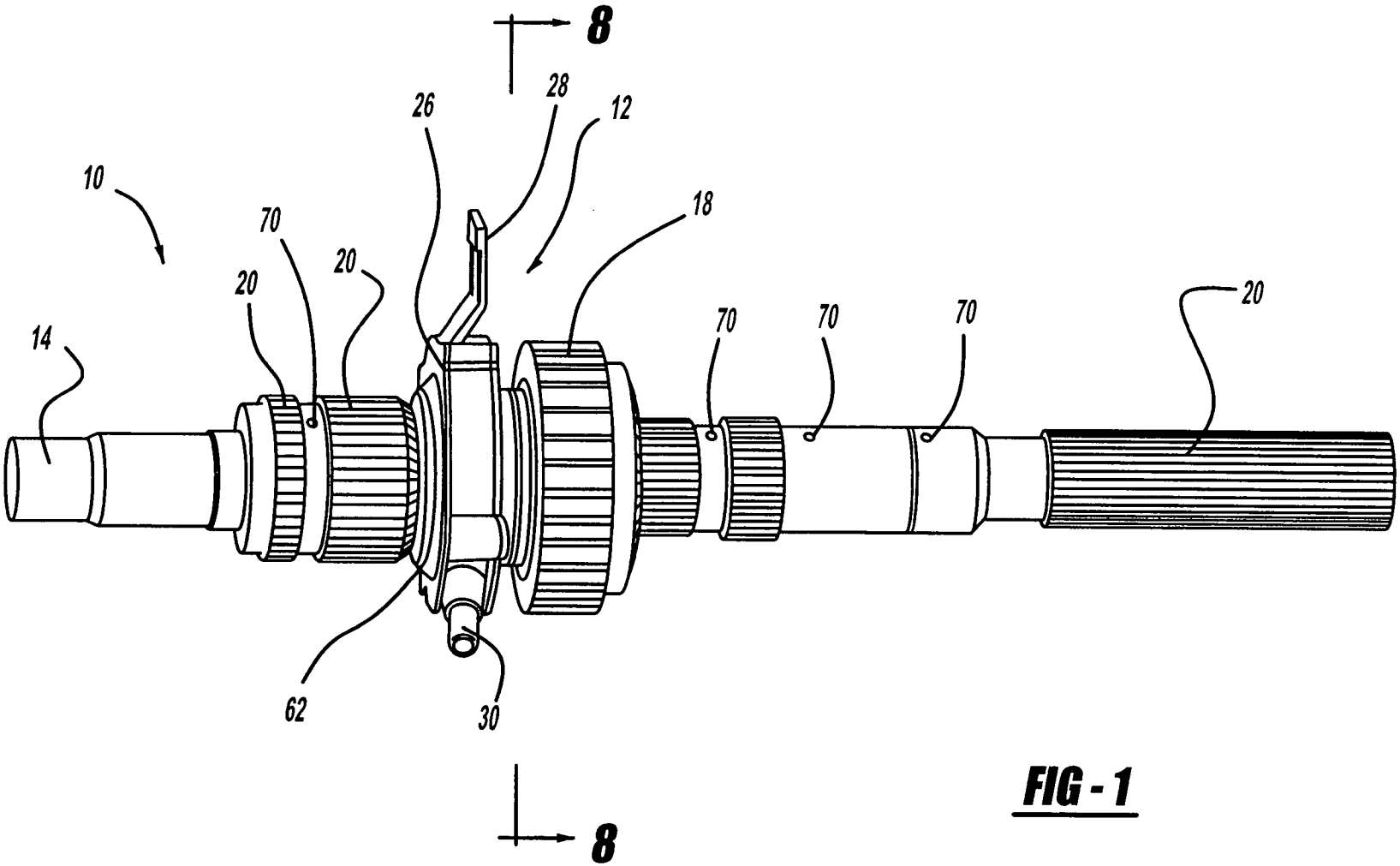
FIG. 1 is a perspective view of a friction drive pump assembly, according to the present invention.

A friction drive pump assembly according to the present invention is generally shown in FIG. 1 at 10. Referring to the Figures generally, the assembly 10 includes a pump, generally shown at 12, mounted on a shaft 14, with the shaft 14 being able to rotate relative to the pump 12. The pump 12 is engagable through the use of an actuator such as a clutch assembly, shown schematically at 16, and a sprocket 18. It should be noted that the clutch assembly may be any type of clutch assembly used for transferring rotational force between two rotating members. One example of this is set forth in U.S. patent application Ser. No. 11/077,616, which has been published as U.S. Patent Application Publication No. 2005/0202920 A1, which in its entirety is incorporated by reference. The shaft 14 includes various teeth 20 which can be used for transferring rotational force to, or receiving rotational force from, other components.

Figure 3:
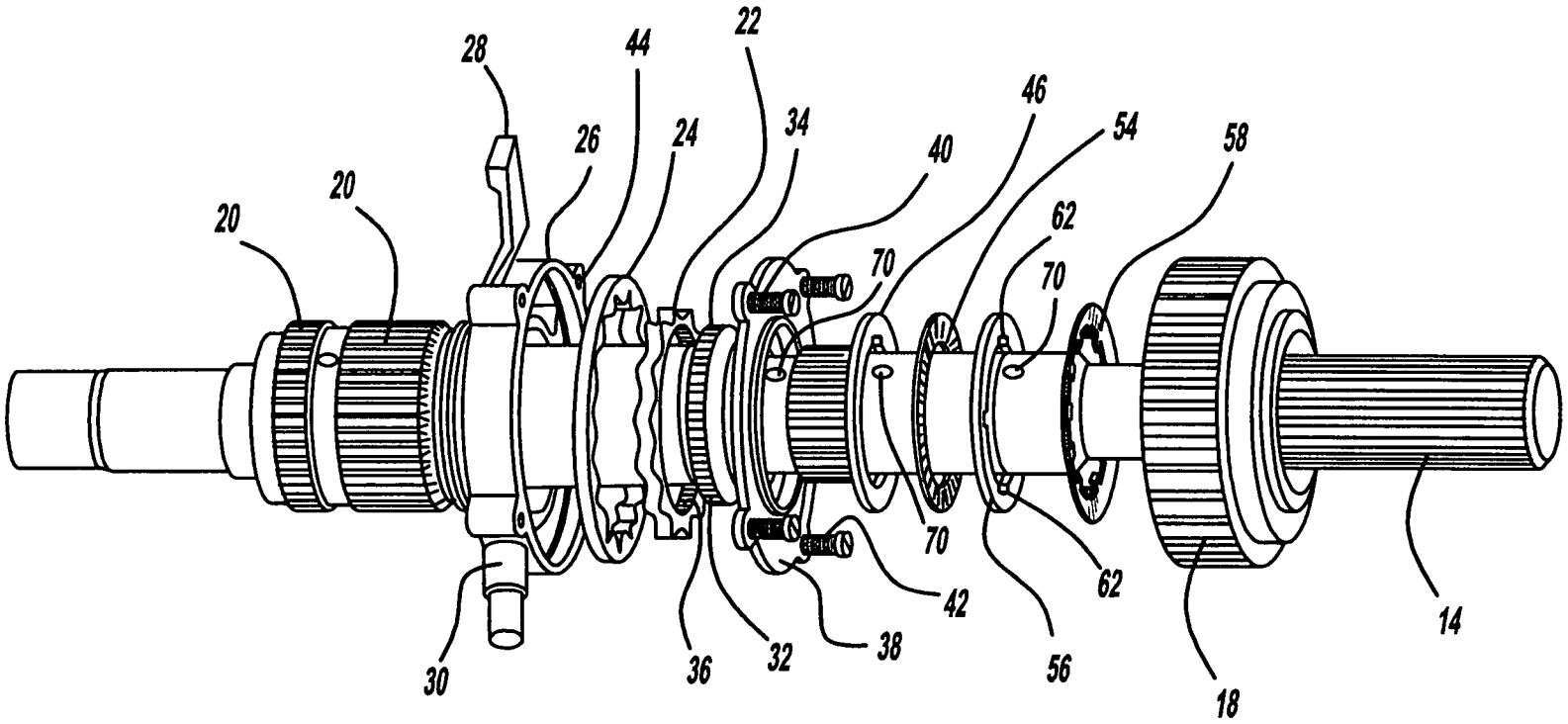
FIG. 3 is an exploded view of a friction drive pump assembly, according to the present invention.

Referring to FIG. 3, the pump 12 is a gerotor pump having an inner gerotor 22 in spline connection with an outer gerotor 24. However, the inner gerotor 22 has less teeth than the outer gerotor 24, and is smaller in diameter. This creates a pumping action between the inner gerotor 22 and the outer gerotor 24 as is generally known. The inner gerotor 22 and the outer gerotor 24 are mounted within a housing 26. The housing 26 has an anti-rotation feature 28 which allows the housing 26 to be connected to the housing of a transmission or transfer case (not shown). The housing 26 also includes a port 30, which is where fluid is drawn into the housing 26 during pumping. The inner gerotor 22 is mounted on a friction drive sleeve 32, and rotates with the friction drive sleeve 32. A portion of the friction drive sleeve 32 has splines 34 which are engaged with corresponding splines 36 on the inner gerotor 22. The inner gerotor 22 and the outer gerotor 24 are held in the housing 26 with a cover plate 38. The cover plate 38 has apertures 40 which receive fasteners 42. The fasteners 42 extend through the apertures 40 and are received by corresponding apertures 44 in the housing 26.

Adjacent to the friction drive sleeve 32 is a first washer 46. The first washer 46 includes a notch 48 which partially receives a ball bearing 50. The ball bearing 50 is also partially received in a notch 52 on the shaft 14. The ball bearing 50 ensures that the first washer 46 rotates with the shaft 14. Also mounted on the shaft 14 is a thrust washer 54, and a second washer 56. Located between the second washer 56 and the sprocket 18 is a spring member in the form of a Belleville Spring 58. The Belleville Spring 58 includes a series of tabs 60 which are received in a series of corresponding notches 62 in the second washer 56. The sprocket 18, the Belleville Spring 58, and the second washer 56 rotate in unison.

The sprocket 18 rotates with the shaft 14 through the use of a spline connection 64. The spline connection 64 allows the sprocket 18 to slide along the shaft 14, and apply force to the Belleville Spring 58, the function of which will be described later.

Figure 2:
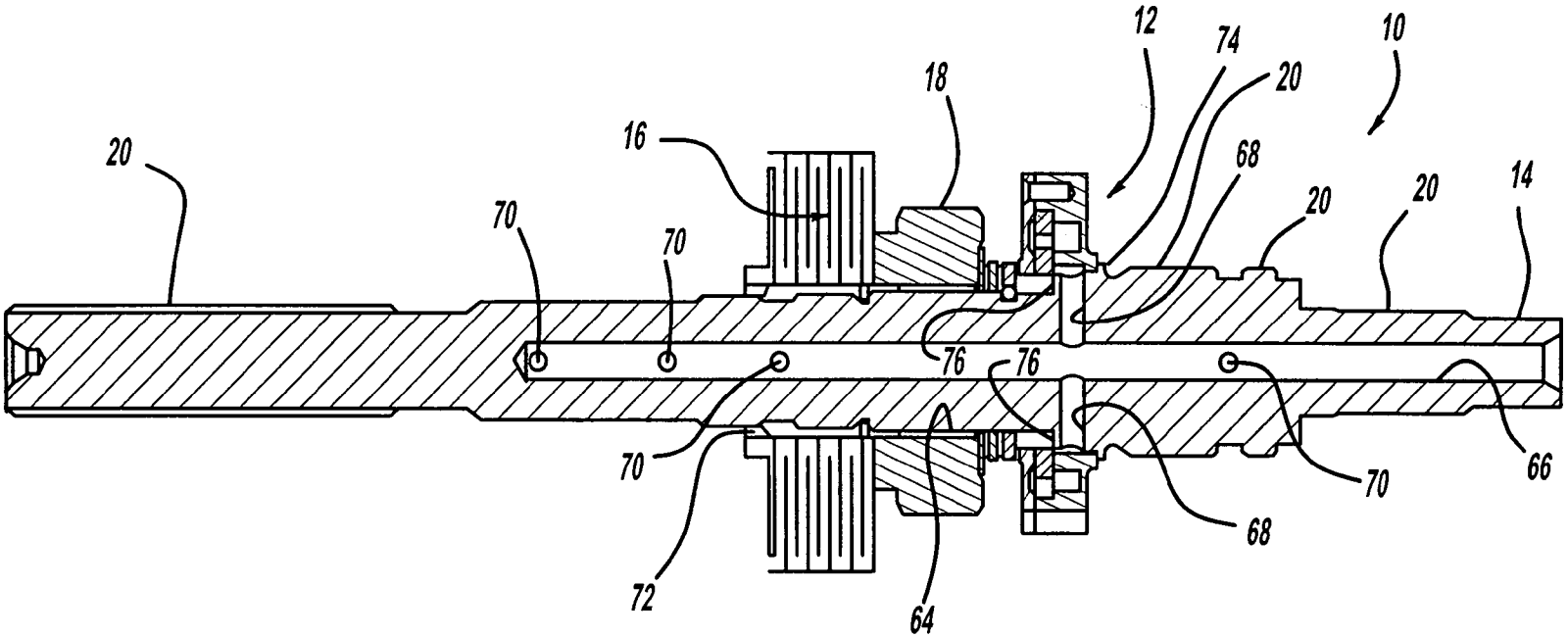
FIG. 2 is a sectional side view of a friction drive pump assembly, according to the present invention.
Figure 4:
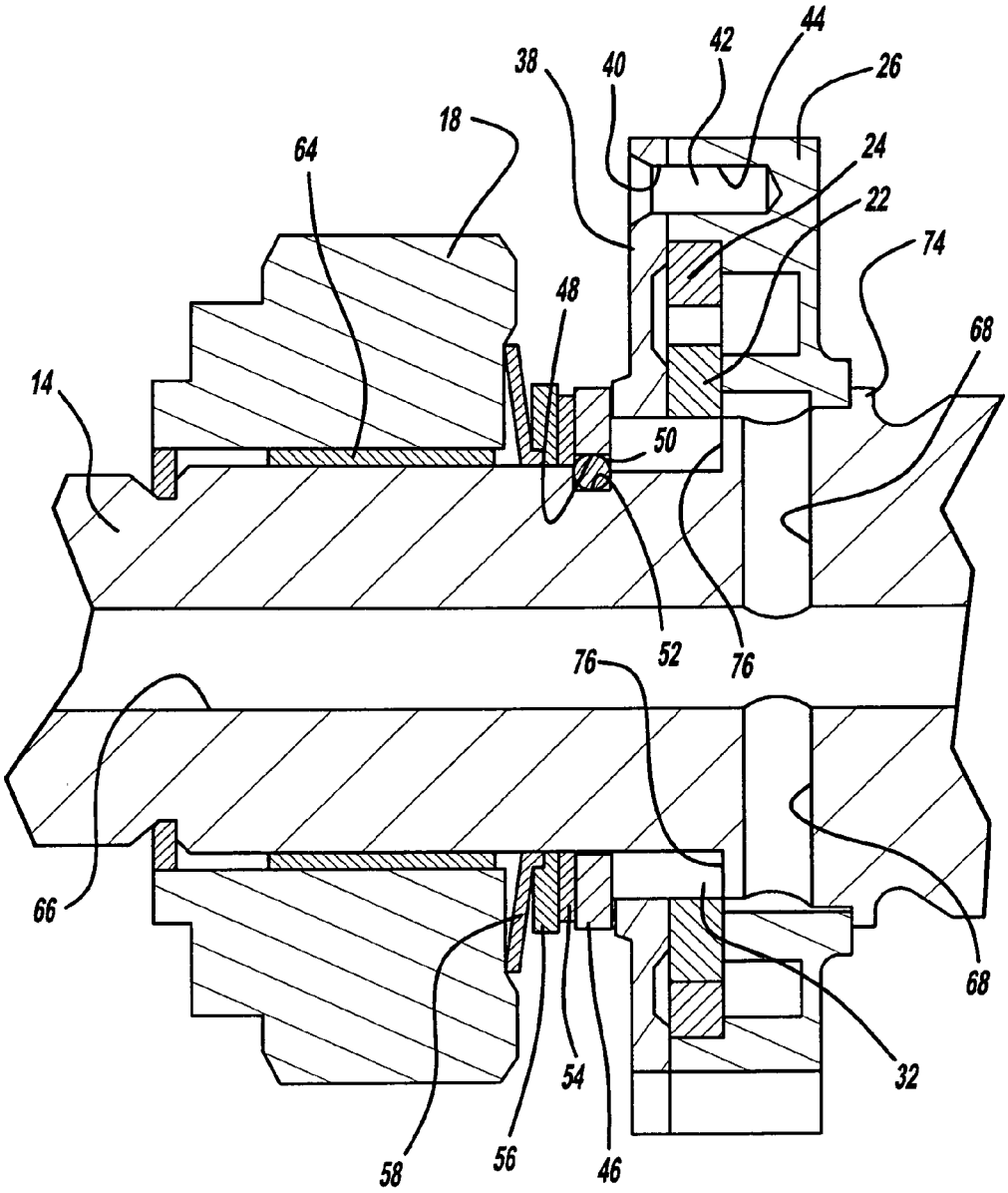
FIG. 4 is an enlarged sectional view of a friction drive pump assembly in a deactivated state, according to the present invention.

Referring now to FIGS. 2 and 4, the shaft 14 is partially hollow, and includes a bore 66 which is in fluid communication with a first set of side bores 68, and a second set of side bores 70. The side bores 68 receive fluid from the pump 12. The clutch assembly 16 is held in place on the shaft 14 because of a snap ring 72. The shaft 14 also has a notch 74 which acts to locate the pump 12. The pump 12, clutch assembly 16, and sprocket 18 are located on the shaft 14 between the snap ring 72 and the notch 74. Also included on the shaft 14 is a shoulder 76 which receives force from the friction drive sleeve 32 when the friction drive sleeve 32 receives force from the Belleville spring 58.

In operation, the shaft 14 may be used in a transmission or transfer case, or another device in which a pumping action for fluid is necessary. The shaft 14 will rotate and receive rotational power from another shaft or gear in the transmission or transfer case. Fluid is drawn into the pump 12 through the port 30. The port 30 receives fluid from a sump (not shown). As the shaft 14 rotates and if the clutch assembly 16 is actuated, the pump 12 draws in fluid from the port 30, and forces the fluid into the first set of side bores 68. The fluid is then forced to flow through the bore 66, and out of the second set of side bores 70. The fluid flowing out of the second set of side bores 70 can be used to lubricate other various components mounted on the shaft 14. When the pump 12 is not actuated by the clutch assembly 16, the pump 12 will only transfer a minimal amount of fluid.

When it is desired to have the pump 12 transfer an increased amount of fluid, the clutch assembly 16 is actuated; the clutch assembly 16 will apply force to the sprocket 18. The sprocket 18 will translate to the right when looking at FIGS. 2, 4, and 5, and apply a compressive force to the Belleville Spring 58, which translates through the first washer 46, the thrust washer 54, the second washer 56, and to the friction drive sleeve 32. The friction drive sleeve 32 will then be pressed against the shoulder 76. As the amount of force applied to the friction drive sleeve 32 increases, the amount of frictional force between the shoulder 76 and the friction drive sleeve 32 increases as well. As the frictional force between the shoulder 76 and the friction drive sleeve 32 increases, the amount of rotational force transferred from the shaft 14 to the friction drive sleeve 32 also increases. As the friction drive sleeve 32 rotates, the inner gerotor 22 will also rotate. As the inner gerotor 22 rotates, the outer gerotor 24 will rotate, and the inner gerotor 22 and the outer gerotor 24 will create a pumping action. When this occurs, the fluid that is fed into the pump 12 from the port 30 will be pumped into the first set of side bores 68, the bore 66, and the second set of side bores 70 under a predetermined pressure by the pumping action created by the inner gerotor 22 and the outer gerotor 24.

Figure 5:
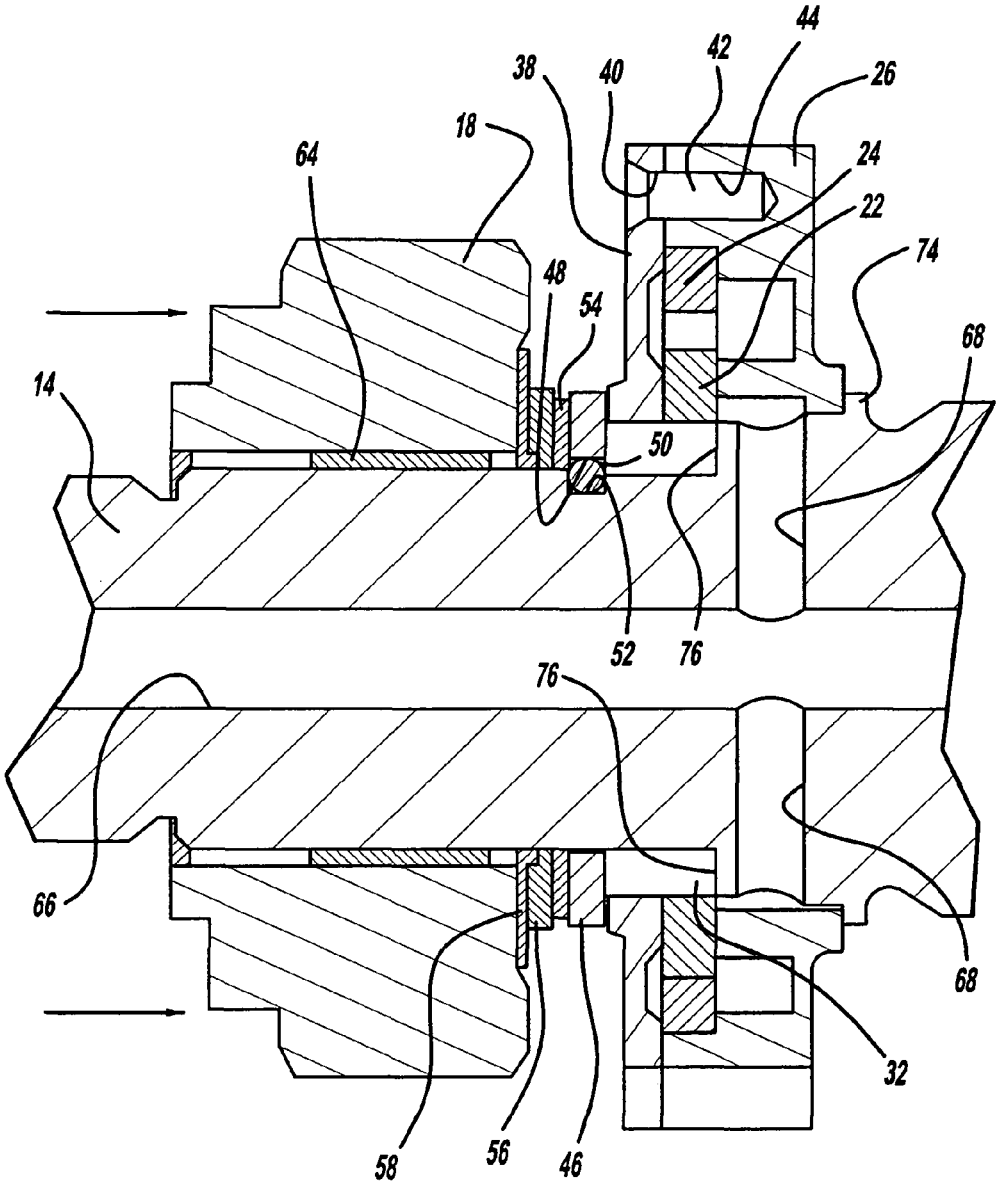
FIG. 5 is an enlarged sectional view of a friction drive pump assembly in an activated state, according to the present invention.
Figure 6:
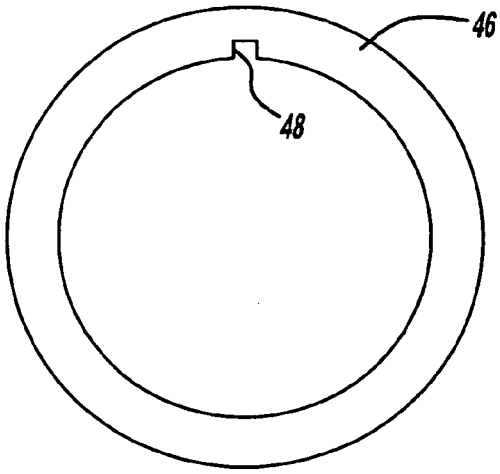
FIG. 6 is a side view of a first washer used in a friction drive assembly, according to the present invention.
Figure 7:
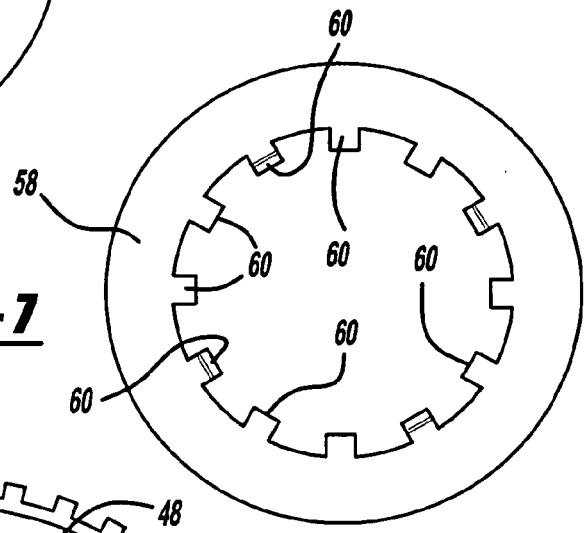
FIG. 7 is a side view of a spring member used in a friction drive assembly, according to the present invention.
Figure 8:
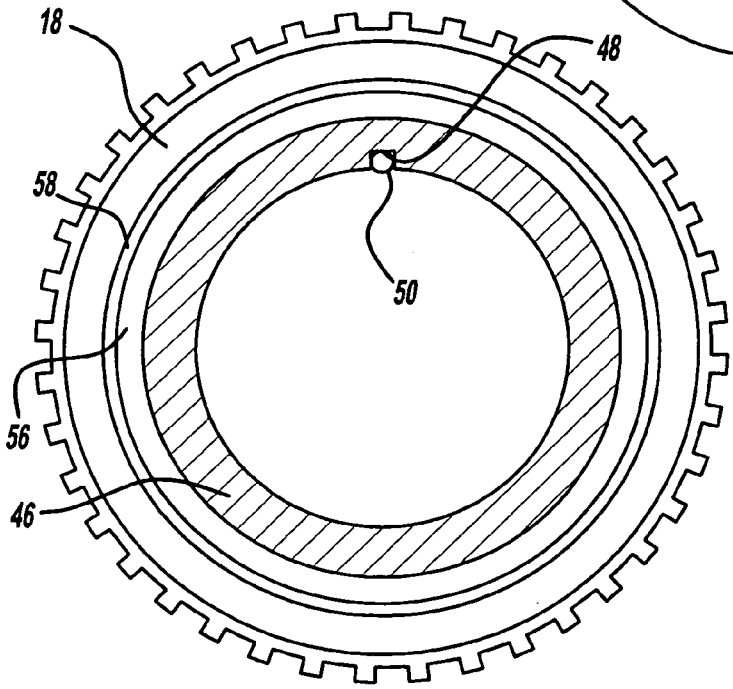
FIG. 8 is a sectional view taken along lines 8-8 of FIG. 1.

If the Belleville Spring 58 is fully compressed, the friction drive sleeve 32, and therefore the inner gerotor 22, will have the same angular velocity as the shaft 14, and the maximum amount of pumping action will be created. When the clutch assembly 16 is actuated in this manner, the minimum amount of thrust (with the thrust being the lateral force applied to move the sprocket 18 rightward when looking at FIGS. 4 and 5) will be greater than 1000 N, which will flatten the Belleville Spring 58 as shown in FIG. 5, creating a drive capability which is in excess of the 5 N-m of torque required to drive the pump 12.

It should be noted that when the clutch assembly 16 is deactivated, there will still be a light amount of thrust applied to the friction drive sleeve 32; the thrust will be between 150-200 N, which is applied to the friction drive sleeve 32 from the Belleville Spring 58. Therefore, rotational force will still be transferred from the shaft 14 to the friction drive sleeve 32. This will result in a drive capability for the pump 12 being approximately 1.5 N-m. This reduced drive torque limits the speed of the pump 12, and reduces pumping losses. The reduced pumping losses will improve the efficiency of the friction drive pump assembly 10 because the pump 12 has the ability to be actuated only when needed.

Figure 9:
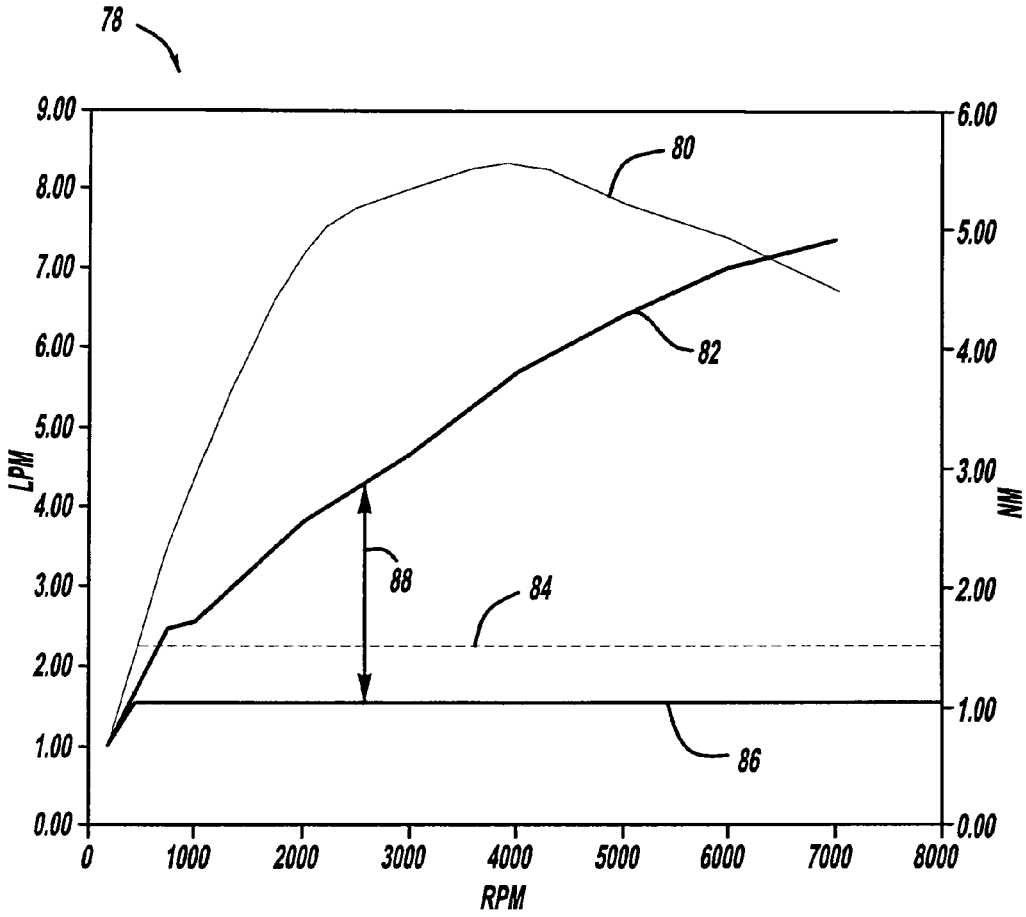
FIG. 9 is a chart displaying fluid flow and torque characteristics of a friction drive assembly, according to the present invention.

The advantages of the present invention can also be seen in FIG. 9. FIG. 9 shows a chart, generally shown at 78, which shows a flow rate 80, and a torque input 82 for a friction drive pump assembly 10 made according to the present invention when the gerotor pump 12 is activated in a manner such that the friction drive sleeve 32 is rotating at the same speed as the shaft 14. The chart 78 also includes a flow rate 84 and a torque input 86 when the gerotor pump 12 is not activated. As mentioned previously, even when the clutch assembly 16 is not actuated, there is still a light amount of thrust applied to the friction drive sleeve 32 from the Belleville Spring 58, which results in a torque of a little over 1.0 N-m applied to the pump (shown by curve 86). This allows the pump 12 to provide necessary minimum oil flow during low-demand operating conditions. The pump 12 can be actuated for higher output conditions if desired, but does not use engine power resources unless required. By way of non-limiting example, at 2400 rpm, the difference between the amount of torque the gerotor pump 12 would use between an active and inactive state, shown at 88, is almost 2 N-m. This means that the shaft 14 would need to exert almost 2 N-m less torque to operate. This yields an increase in fuel economy of 1.5%. Similar improvements in efficiency can be seen at other locations on the curves showing flow rates 80,84 and torque inputs 82,86, and comparing between the active an inactive states.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A pump, comprising:

an actuator mounted on a rotatable shaft;

said actuator further comprising a clutch assembly;

a sprocket adjacent said clutch assembly;

at least one washer adjacent to, and in contact with, said friction drive sleeve;

a spring member disposed between said sprocket and said at least one washer; and when said clutch assembly is not actuated, said friction drive sleeve will receive a minimal amount of force from said spring members, and said shaft will transfer a minimal amount of rotational force to said friction drive sleeve, and when said clutch assembly is actuated, said clutch assembly will apply enough force to said sprocket such that said sprocket compresses said spring member, causing said shaft to transfer an increased amount of rotational force to said friction drive sleeve;

a pump mounted on said shaft, selectively engageable by said actuator; and said pump comprising:

an inner gerotor;

a friction drive sleeve connected to said inner gerotor, said friction drive sleeve rotatably mounted on said shaft;

an outer gerotor operably associated with said inner gerotor;

wherein when said actuator is actuated, said friction drive sleeve will receive rotational force from said shaft, transferring rotational force from said shaft to said inner gerotor, creating a pumping action between said inner gerotor and said outer gerotor.

2. The pump of claim 1, further comprising:

a housing; and at least one port formed as part of said housing such that fluid entering said housing through said at least one port will be pumped when a pumping action is created between said inner gerotor and said outer gerotor.

3. The pump of claim 1, further comprising:

a bore extending through at least a portion of said shaft in proximity to said inner gerotor;

at least one first side bore in fluid communication with said bore and said pump;

at least one second side bore in fluid communication with said bore; and as said shaft rotates and said pump creates a pumping action, fluid will flow from said pump into at least one first side bore, into said bore, and from said bore through said at least one second side bore.

4. A pump which is selectively engageable, comprising:

an actuator circumscribing a shaft;

a gerotor pump mounted on said shaft, operably associated with said actuator;

a sprocket adjacent said actuator;

at least one washer adjacent to, and in contact with, said pump;

a spring member disposed between said sprocket and said at least one washer; and when said clutch assembly is actuated, force will be translated through said sprocket, said spring, and said at least one washer, for engaging said gerotor pump, and causing said gerotor pump to pump fluid.

5. The pump of claim 4, wherein said gerotor pump further comprises:

an inner gerotor;

an outer gerotor which circumscribes said inner gerotor;

a friction drive sleeve mounted on said shaft, engaged with said inner gerotor; and when said clutch assembly is actuated, said friction drive sleeve will received force from said at least one washer, causing shaft to transfer rotational force to said friction drive sleeve and said inner gerotor.

6. The selectively engageable pump of claim 4, wherein said shaft further comprises:

a bore substantially extending through said shaft;

a plurality of first side bores in fluid communication with said bore, said plurality of first side bores operably associated with said pump;

a plurality of second side bores in fluid communication with said bore; and when said pump rotates, fluid will be transferred from said pump to said plurality of first side bores, to said bore, and from said bore to said plurality of second side bores.

7. A method for selectively pumping fluid through a shaft, comprising the steps of:

providing a pump circumscribing a shaft;

providing a friction drive sleeve, operably associated with said pump, said friction drive sleeve circumscribing said shaft;

providing a spring member circumscribing said shaft, said spring member operably associated with said friction drive sleeve;

applying a force to said spring member;

applying a force to said friction drive sleeve as a force is applied to said spring member;

transferring rotational force from said shaft to said pump through said friction drive sleeve, when force is applied to said friction drive sleeve from said spring member;

providing an inner gerotor circumscribed, and in spline connection with an outer gerotor, said inner gerotor also in spline connection with said friction drive sleeve;

rotating said inner gerotor with said friction drive sleeve;

transferring rotational force from said shaft to said inner gerotor from said shaft through said friction drive sleeve; and increasing the amount of rotational force transferred from said shaft to said inner gerotor as said friction drive sleeve receives a greater amount of force from said spring member.

8. The method from selectively pumping fluid through a shaft of claim 7, further comprising the steps of:

providing a plurality of washers mounted on said shaft adjacent said friction drive sleeve, said spring member mounted on said shaft disposed between a sprocket and said plurality of washers;

providing a clutch assembly mounted on said shaft adjacent said sprocket on the opposite side of said sprocket as said spring member; and actuating said clutch assembly;

applying force to said sprocket as said clutch assembly is actuated;

compressing said spring member as a force is applied to said sprocket, thereby applying force to said plurality of washers and said friction drive sleeve, transferring rotational force to said inner gerotor from said shaft; and creating a pumping action between said inner gerotor and said outer gerotor as rotational force is transferred from said shaft to said inner gerotor.

9. The method of selectively pumping fluid through a shaft of claim 7, further comprising the steps of:

providing a bore extending through at least a portion of said shaft;

providing at least one first side bore in fluid communication with said bore and said pump;

providing at least one second side bore in fluid communication with said bore;

rotating said shaft;

creating a pumping action with said pump as said shaft rotates; and pumping fluid into said at least one first side bore with said pump, causing fluid to flow from said at least one first side bore into said bore, and from said bore through said at least one second side bore.

10. The method for selectively pumping fluid through a shaft of claim 7, further comprising the steps of:

providing a housing for receiving said pump; and providing at least one port formed in said housing such that when a pumping action is created by said pump, fluid will flow through said port into said housing.

* * * * *

UNITED STATES PATENT AND TRADEMARK OFFICE

CERTIFICATE OF CORRECTION

PATENT NO. : 8,491,289 B2
APPLICATION NO. : 12/741615
DATED : July 23, 2013
INVENTOR(S) : Dan J. Showalter It is certified that error appears in the above-identified patent and that said Letters Patent is hereby corrected as shown below:

In the Claims

Column 5, Line 62, Claim 5, "received" should be --receive--

Signed and Sealed this
Twenty-ninth Day of July, 2014

Michelle K. Lee

Michelle K. Lee
*Deputy Director of the United States Patent and Trademark Office*